US011029106B2

(12) United States Patent
Law

(10) Patent No.: US 11,029,106 B2
(45) Date of Patent: Jun. 8, 2021

(54) RECOIL SYSTEM FOR USE IN SOME TYPES OF RIFLES

(71) Applicant: Zachary Law, Perkasie, PA (US)

(72) Inventor: Zachary Law, Perkasie, PA (US)

( * ) Notice: Subject to any disclaimer, the term of this patent is extended or adjusted under 35 U.S.C. 154(b) by 0 days.

(21) Appl. No.: 16/579,820

(22) Filed: Sep. 23, 2019

(65) Prior Publication Data

US 2020/0158451 A1 May 21, 2020

Related U.S. Application Data

(63) Continuation of application No. 15/706,386, filed on Sep. 15, 2017, now Pat. No. 10,422,595.

(60) Provisional application No. 62/394,781, filed on Sep. 15, 2016.

(51) Int. Cl.
*F41A 3/82* (2006.01)
*F41C 23/04* (2006.01)

(52) U.S. Cl.
CPC ..... *F41A 3/82* (2013.01); *F41C 23/04* (2013.01)

(58) Field of Classification Search
CPC ..... F41A 3/68; F41A 3/78; F41A 3/82; F41C 23/04
USPC ..... 89/199
See application file for complete search history.

(56) References Cited

U.S. PATENT DOCUMENTS

| | | | | |
|---|---|---|---|---|
| 2,403,306 | A * | 7/1946 | Sampson | F41A 3/64 89/197 |
| 3,363,351 | A * | 1/1968 | Smith | F41A 3/64 42/16 |
| 4,227,439 | A * | 10/1980 | Gillum | F41A 3/40 89/180 |
| 2011/0277368 | A1* | 11/2011 | Overstreet | F41A 3/64 42/108 |
| 2018/0010879 | A1* | 1/2018 | Bonine | F41A 3/86 |
| 2018/0224227 | A1* | 8/2018 | Durham, III | F41A 3/82 |

* cited by examiner

*Primary Examiner* — Samir Abdosh
(74) *Attorney, Agent, or Firm* — Muskin + Farmer, LLC

(57) ABSTRACT

The present device is a shortened recoil system designed to replace the AR-15 type recoil system, comprising the standard recoil systems of many commonly used rifles including the AR-10, AR-15, M-16 and M-4. This shortened recoil system removes or replaces the parts of the traditional recoil system located in the stocks of these rifles and place the entire recoil system within the receiver, while maintaining the alignment of the recoil system with the barrel of the rifle. A major advantage of the present system is that it allows the rifle to be fired with a folded stock or even with no stock at all, as no part of the present recoil system is located within the stock.

9 Claims, 9 Drawing Sheets

RECOIL SYSTEM FOR USE IN SOME TYPES OF RIFLES

CROSS-REFERENCE TO RELATED APPLICATIONS

This application claims benefit to provisional application No. 62/394,781, filed Sep. 15, 2016, which is incorporated by reference herein in its entirety.

FIELD OF THE INVENTION

The present apparatus is an improved recoil system for use in rifles incorporating the Stoner Direct Impingement Gas System ("SDIGS"), including the AR-10, AR-15, M-16 and M-4 series of rifles.

BACKGROUND

On Sep. 6, 1960, Eugene Stoner was granted U.S. Pat. No. 2,951,424 for a "Gas Operated Bolt and Carrier System" which is used in the design of the AR-10, AR-15, M-16 and M-4 series of rifles (sometimes referred to herein collectively as "AR-15 rifles" or "AR-15's"). This system is referred to as a "direct impingement system" because some of the gas from a fired cartridge is redirected so that it interacts directly with the rifle's bolt carrier assembly to actuate it. Specifically, as it relates to the rifles listed above, the gas drives the bolt carrier assembly backward, ejecting the shell. A recoil spring then pushes the bolt carrier forward again allowing a new cartridge from a magazine to be loaded into the barrel, thus completing the cycle of the bolt carrier assembly, wherein the bolt carrier moves back to its original position. Despite some drawbacks, the Stoner design has been extremely successful as proven by its use in millions of rifles for many decades.

The main advantages of the Stoner design relate to the simplicity of the gas system and the fact that all moving parts of the recoil systems are in line with the bore. Specifically, the muzzle, barrel, bolt, bolt carrier, buffer and recoil spring all exist along the same axis in the Stoner design giving these rifles low perceived recoil and improving accuracy by limiting muzzle rise. However, a disadvantage of the Stoner system is that the recoil buffer and recoil spring are typically located in the stock of the rifle limiting certain modifications to the rifle which can be made to those using different types of recoil systems. For example, until recently, this design did not allow for the use of a folding stock, which can be very useful for rifles used in vehicles, planes and other places where space is limited. This limitation was overcome by U.S. Pat. No. 8,769,855 which disclosed a folding stock adapter for use with the AR-10, AR-15, M-16 and M-4 series of rifles. However, even this system does not allow a rifle to be fired repeatedly when the stock is in a folded position.

The later generation AR-18 was developed using the same rotating-bolt locking mechanism used in the Stoner design, but also used a shorter recoil system comprising two short recoil springs on guide rods rather than one large recoil spring located within the stock as found in the AR-15. The AR-18 uses a piston system rather than a direct impingement system, meaning that the gas actuates a piston, rather than directly actuating the bolt carrier system such as the SDIGS, which then actuates the bolt carrier system. The shorter recoil system of the AR-18 is located in the upper receiver, taking any function of the stock out of the recoil system, thus allowing the stock to be folded or even removed without affecting the weapon's ability to function properly. However, a drawback of the recoil system used in the AR-18 is that the gas piston system is located in the upper receiver, which is not in line with the barrel of the rifle. Rather, the recoil system of the AR-18 is in line with the gas piston system and operating rod, placing its recoil springs above the bolt carrier and above the barrel and bore. Because the operating rod and recoil system is above, and not in line with the muzzle, barrel, and bolt, a loss of accuracy due to muzzle rise and perceived recoil is possible.

What is needed is a shortened recoil system that uses direct impingement and is in line with the barrel and bore of the rifle.

SUMMARY OF THE INVENTION

It is an aspect of the present inventive concept to provide a shortened recoil system, using direct impingement, that is in line with the barrel and bore of the rifle thus improving the inherent accuracy of the rifle, by reducing muzzle rise, and reducing perceived recoil.

The above aspects can be obtained by a shortened recoil system comprising: a bolt carrier, which is configured for use in a gas impingement system, wherein the bolt carrier comprises one or more guide rod channels; one or more guide rods configured to fit within the guide rod channel; one or more recoil springs through which a guide rod can be threaded; and a rear plate configured to hold one or more guide rods in a selected position.

The above aspects can also be obtained by a shortened recoil system comprising: a bolt carrier, which is configured for use in a gas impingement system, wherein the bolt carrier comprises one or more guide rod channels; one or more guide rods configured to fit within the guide rod channel; one or more recoil springs through which a guide rod can be threaded; and a rear plate configured to hold one or more guide rods in a selected position; and a rear cup configured to fit within the rear threaded section of the receiver and comprise a recess configured to receive and secure the rear plate.

The above aspects can also be obtained by a method for using a shortened recoil system comprising: providing a bolt carrier, which is configured for use in a gas impingement system, wherein the bolt carrier comprises one or more guide rod channels; one or more guide rods configured to fit within the guide rod channel; one or more recoil springs through which a guide rod can be threaded; and a rear plate configured to hold one or more guide rods in a selected position; providing a rifle comprising an AR-15 rifle comprising a standard bolt carrier system; removing the standard bolt carrier system from the AR-15 rifle; installing the shortened recoil system in the AR-15 rifle; and operating the AR-15 rifle.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
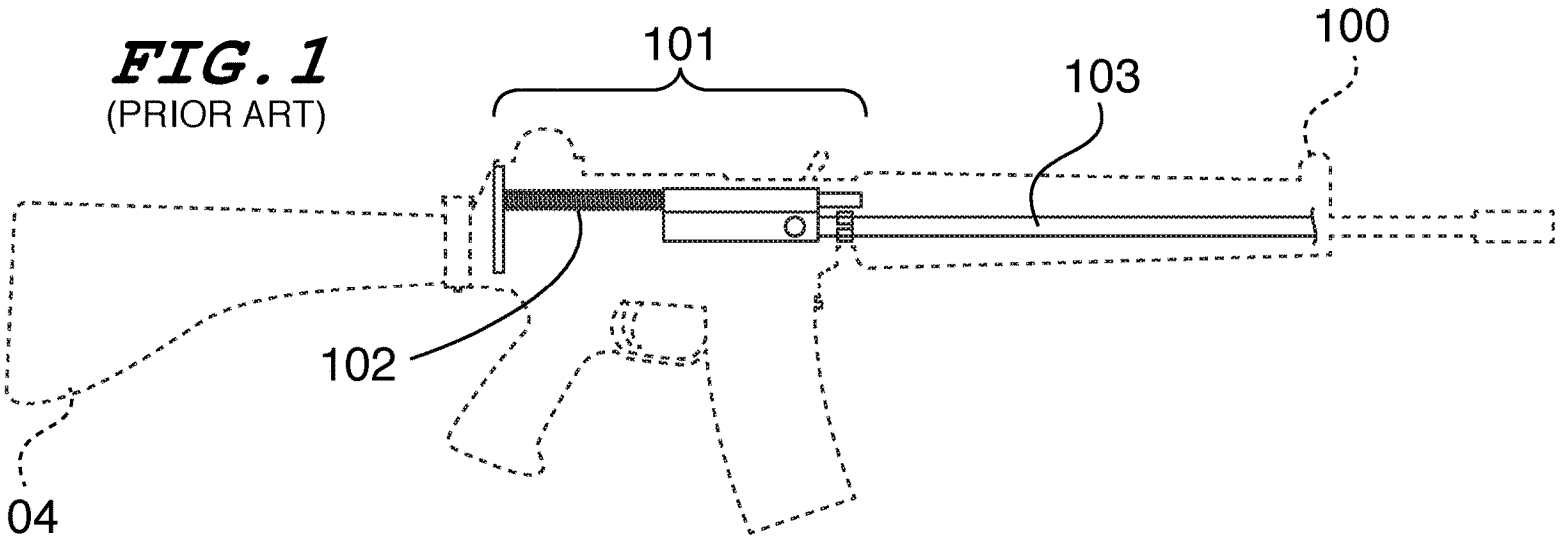
FIG. 1 (PRIOR ART)
FIG. 1 is a side, partially transparent view of the short recoil system found in the AR-18 rifle (prior art)

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present shortened recoil system is a modification of the SDIGS system, which is presently used in millions of AR-10, AR-15, M-16 and M-4 series rifles. This system captures and redirects some of the gas created when a cartridge is fired and uses that gas, and the pressure it creates, in conjunction with one or more recoil springs, to cycle the bolt carrier, ejecting the empty shell and loading a new cartridge. This very well-known and commonly used SDIGS configuration in a traditionally configured AR-15 rifle extends through the receiver and through much of the length of the stock. The present apparatus comprises a shortened bolt carrier, replaces the standard recoil spring with a new recoil spring system and uses additional modifications which allow the recoil system to be contained wholly within the receiver, making the traditional function of the stock, as it relates to the functioning of the SDIGS system in the AR-15 rifle, unnecessary. In other words, an AR-15 equipped with the present shortened recoil system can be fired and otherwise operated normally, with a folded stock, an alternative stock containing no moving parts, or with no stock at all. The present recoil system is configured for use with, and to be part of the Stoner Direct Impingement System as described in U.S. Pat. No. 2,951,424, which is incorporated by reference herein, in its entirety, but with the modifications disclosed herein.

FIG. 1 is a side, partially transparent view of a shortened recoil system 101 found in the standard AR-18 rifle 100 which is part of the prior art. This figure clearly shows that in the AR-18 rifle 100, the recoil springs 102 are located in a plane above that of the gun barrel 103. This figure also clearly shows that no part of the AR-18's recoil system 101 is located within the stock 104 of the rifle 100. As discussed above, a disadvantage of the AR-18's recoil system 101 is that it is located in a plane above rather than in line with the barrel 103 of the rifle 100, which is also clearly shown in FIG. 1. The AR-18 rifle 100 is also incompatible with the popular AR-15 components, which widely available.

Figure 2:
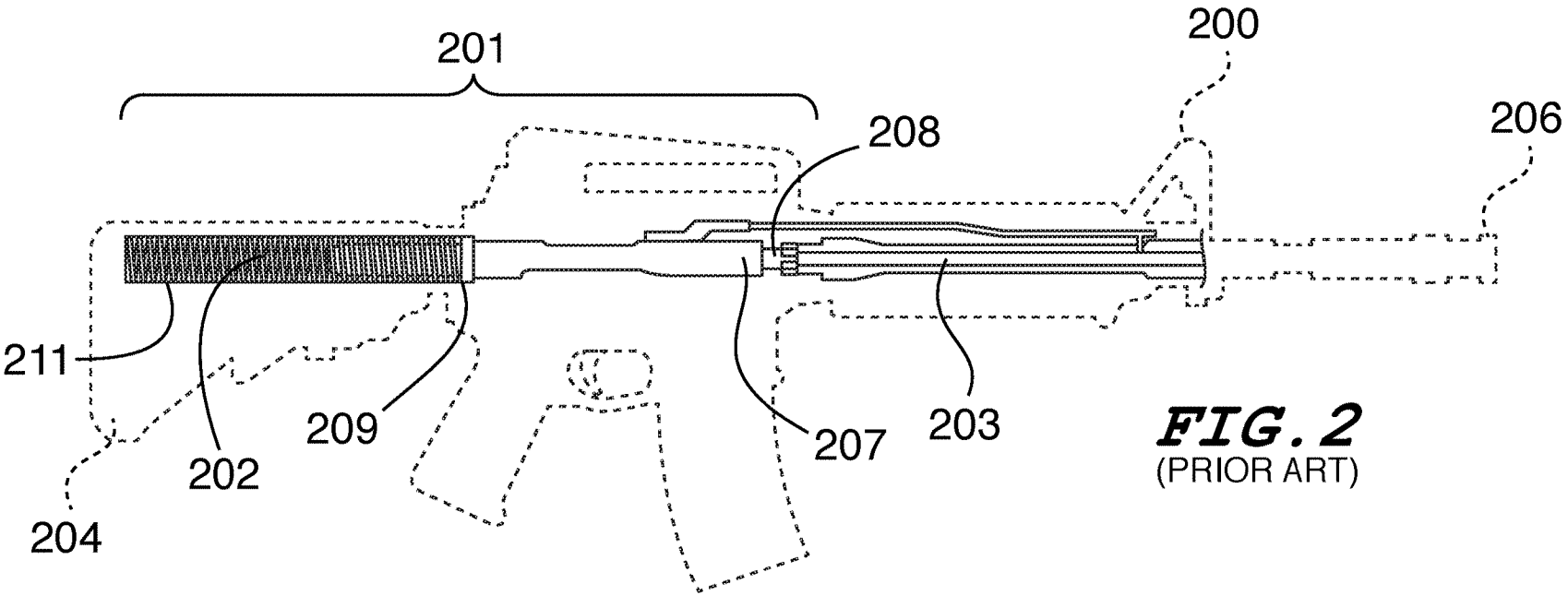
FIG. 2 (PRIOR ART)
FIG. 2 is a side, partially transparent view of the standard bolt carrier system used in the design of the AR-10, AR-15, M-16 and M-4 series of rifles (prior art), wherein the muzzle, barrel, bolt, bolt carrier, buffer and recoil spring are all inline.

FIG. 2 is a side, partially transparent view of the bolt carrier system 201 used in the standard design of the AR-15 rifles 200, which are also part of the prior art, wherein the muzzle 206, barrel 203, bolt 208, bolt carrier 207, buffer 209 and recoil spring 202 are all inline, located within the same plane, which can prevent a loss of accuracy due to muzzle rise and reduce perceived recoil. Also, as can clearly be seen when comparing FIG. 1 to FIG. 2, the recoil system 101 of the AR-18 rifle 100 is much shorter than the recoil system 201 of the AR-15 rifle 200 shown in FIG. 2. The traditional recoil system 201 used in AR-15's and related rifles extends substantially into its stock 204. Specifically, the buffer 209 and recoil spring 202 are almost entirely located within the stock and within the buffer tube 211. A clear disadvantage of the traditional AR-15 recoil system 201, is that it makes the use of folding stocks difficult and the use of the rifle without a stock impossible. Furthermore, even when using a folding stock adaptor (both shown in FIG. 2), such as that described in U.S. Pat. No. 8,769,855, the AR-15 rifle 200 cannot be operated with the stock 204 in a folded position.

Figure 3:
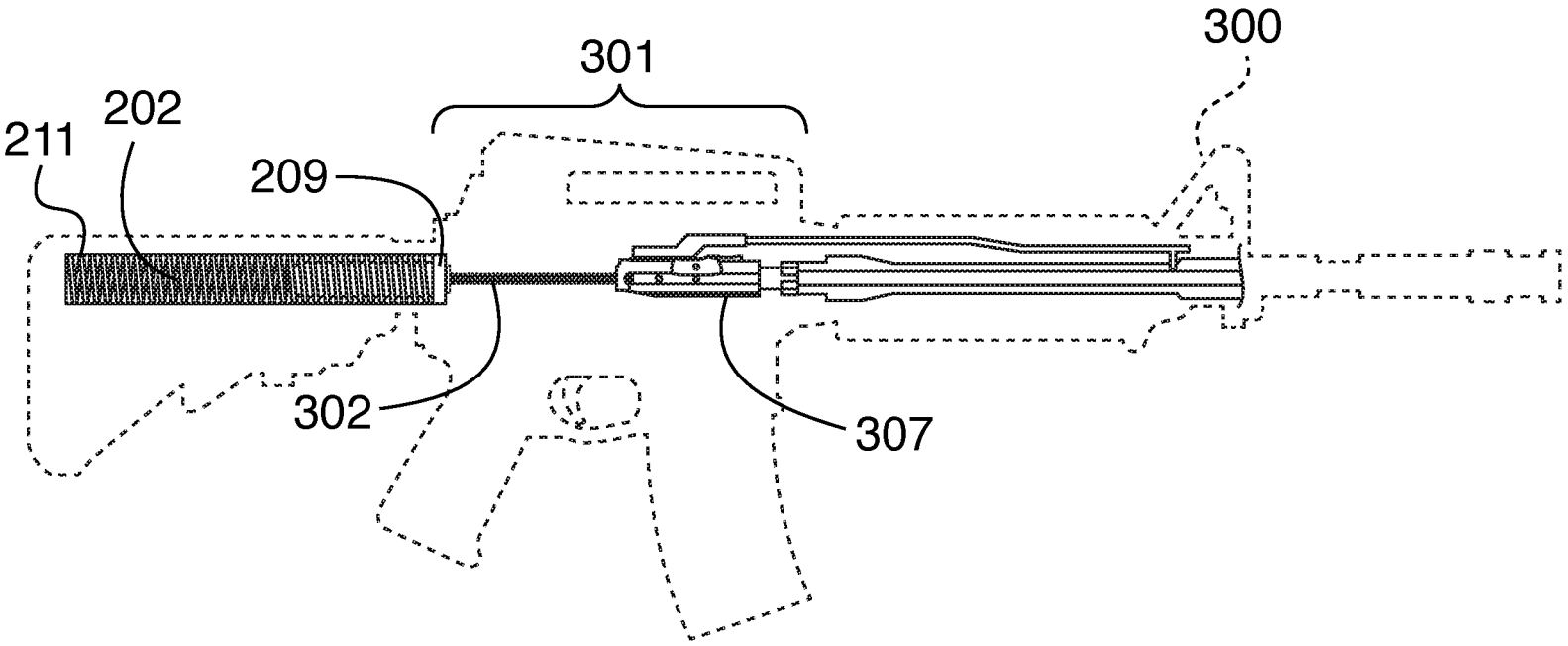
FIG. 3 is a side, partially transparent view of the present shortened recoil system in an AR-15 rifle, including a shortened bolt carrier and inline recoil springs wherein the buffer and spring components of the standard bolt carrier system, as shown in FIG. 2, are left in place, according to an embodiment.

FIG. 3 is a side, partially transparent view of the present shortened recoil system 301 installed in an AR-15 rifle 300, including a shortened bolt carrier 307 and inline recoil springs 302 wherein the buffer 209 and buffer spring 202 components of the standard bolt carrier system, as shown in FIG. 2, are left in place. The primary benefit of this embodiment is that is allows the user the ability to install and use the shortened recoil system 301, but retains the ability of the user to easily reinstall the bolt carrier system 201 used in the standard design of the AR-15 rifles 200. This embodiment also allows for the use of the present shortened recoil system 301 without a rear cup or similar retaining device (not shown in FIG. 3), discussed in further detail below, as the present shortened recoil system 301 can be partially held in place by the buffer 209.

Figure 4:
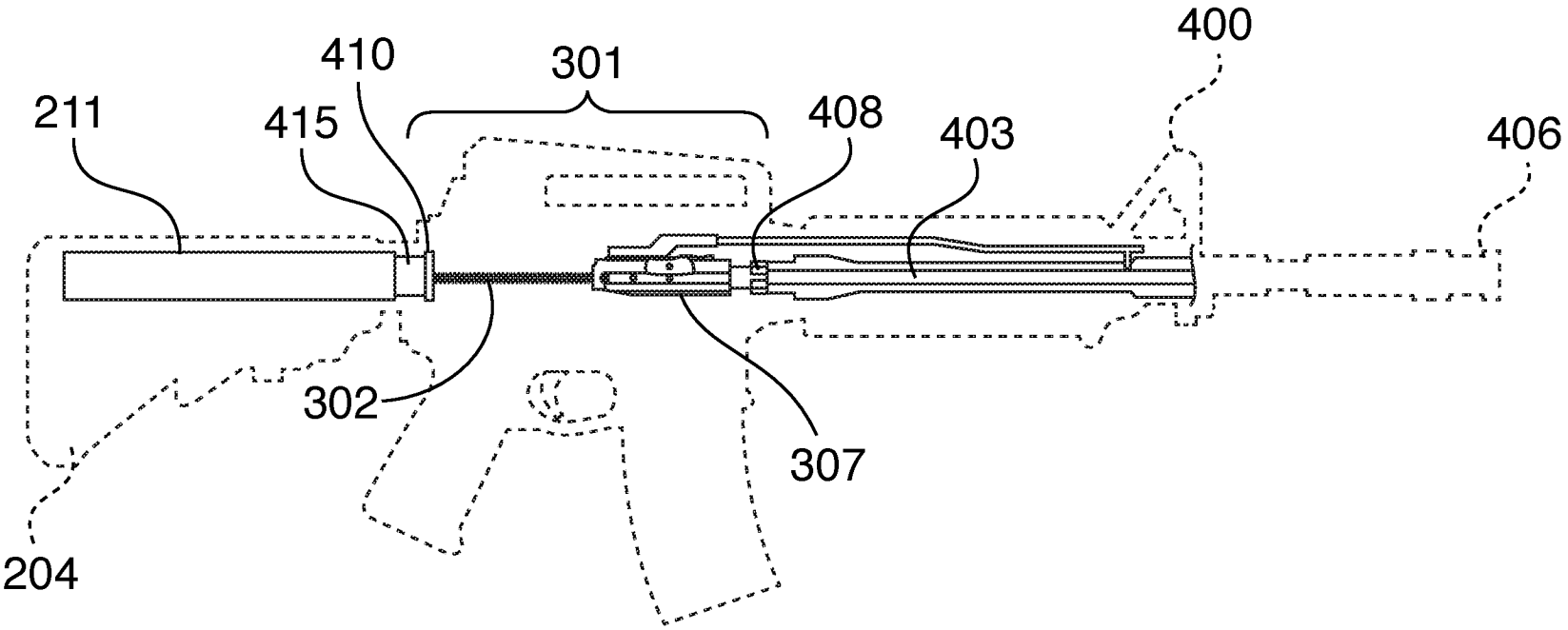
FIG. 4 is a side, partially transparent view of the present shortened recoil system installed in an AR-15 rifle, including a shortened bolt carrier and inline recoil springs wherein the buffer and spring components have been removed, according to an embodiment.

FIG. 4 is a side, partially transparent view of the present shortened recoil system 301 installed in an AR-15 rifle 400, including the shortened bolt carrier 307 and inline recoil springs 302, wherein the buffer 209 and buffer spring 202 (shown in FIG. 2) are not present in the in the depicted embodiment. The present shortened recoil system 301 removes or replaces several of the parts of the traditional recoil system 201 used in AR-15 rifles 200 (shown in FIG. 2). Specifically, the buffer tube 211 is blocked by a rear cup 415, which fits into the rear threaded section of the receiver 410, allowing for the removal of the traditional buffer 209 and traditional recoil spring 202 (not shown in FIG. 4), which are not required parts for the operation of the present shortened recoil system 401. This modification allows for the use of simple folding stock designs, or stock designs that are not configured to contain a buffer tube 211 and allows the rifle 400 to be fired while the stock 204 is folded or even if the stock 204 is entirely removed. Furthermore, the present shortened recoil system 301, when installed in the AR-15 rifle 400, or similar rifles, maintains one of the most beneficial features of the AR-15 rifle 400, which is that it allows the muzzle 406, barrel 403, bolt 408, bolt carrier 307, and recoil springs 302 to be located generally inline, along the same axis, which reduces or prevents muzzle rise and minimizes perceived recoil.

Figure 5:
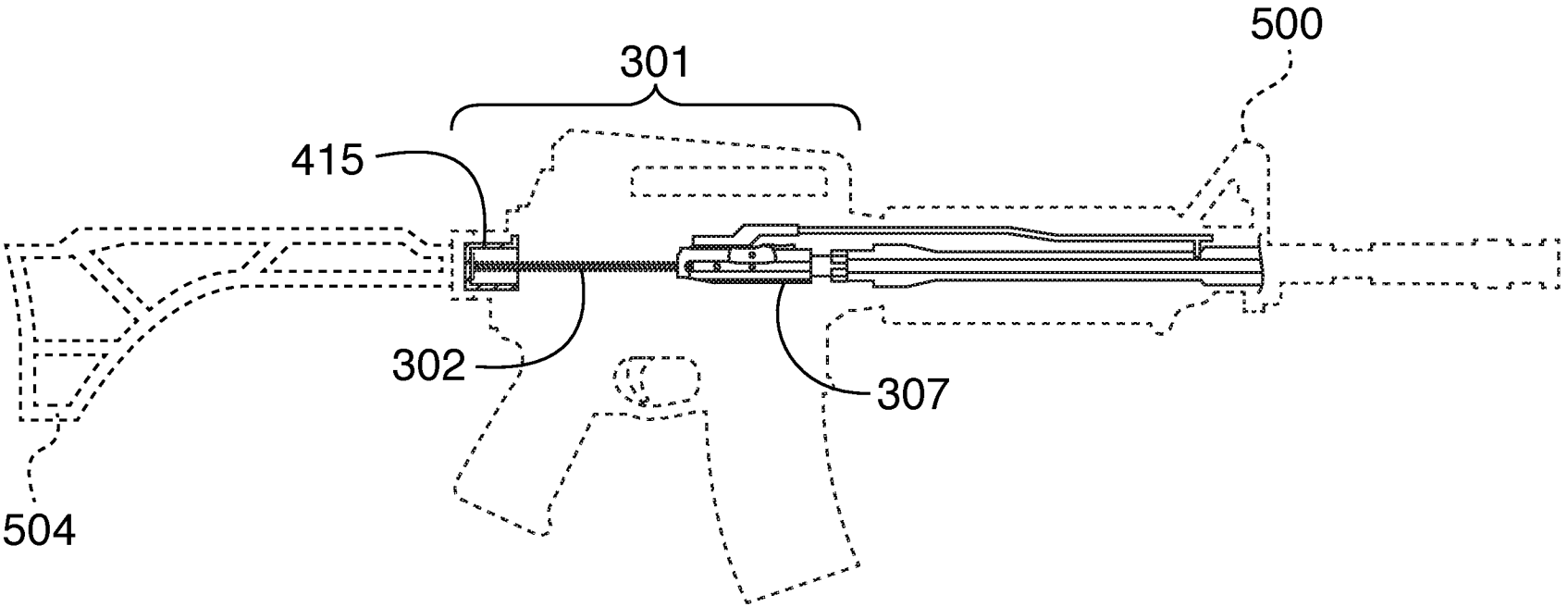
FIG. 5 is a side, partially transparent view of the present shortened recoil system installed in an AR-15 rifle, including a shortened bolt carrier and inline recoil springs, wherein the stock has been replaced with an alternative stock incapable of containing a buffer and recoil spring of the standard bolt carrier system depicted in FIG. 2, according to an embodiment.

FIG. 5 is a side, partially transparent view of the present shortened recoil system 301 in an AR-15 rifle 500, including a shortened bolt carrier 307 and inline recoil springs 302, wherein the stock has been replaced with an alternative stock 504 incapable of containing a buffer and recoil spring (not shown). In this embodiment, the rear cup 415 can be installed within the rear threaded section of the receiver 410, thus securing the present shortened recoil system 301 in place, according to an embodiment. In this embodiment, the rear cup 415 acts to seal the receiver, thereby separating it and the moving parts of the rifle 500 from the stock 504.

Figure 6:
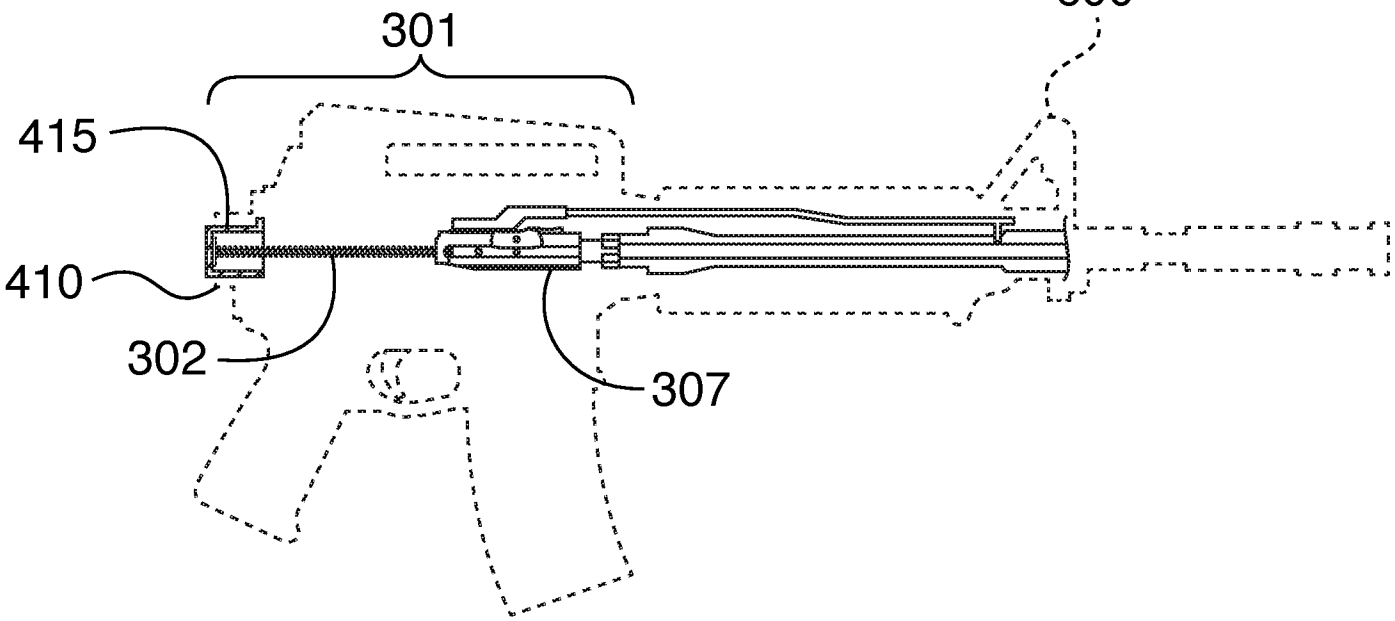
FIG. 6 is a side, partially transparent view of the present shortened recoil system in an AR-15 rifle, including a shortened bolt carrier and inline recoil springs, wherein the stock has been completely removed, according to an embodiment.

FIG. 6 is a side, partially transparent view of the present shortened recoil system 301 in an AR-15 rifle 600, including a shortened bolt carrier 307 and inline recoil springs 302, wherein no stock, according to an embodiment. As with the embodiment depicted in FIG. 5, the rear cup 415 can be installed within the rear threaded section of the receiver 410, thus securing the present shortened recoil system 301 in place, according to an embodiment.

Figure 7:
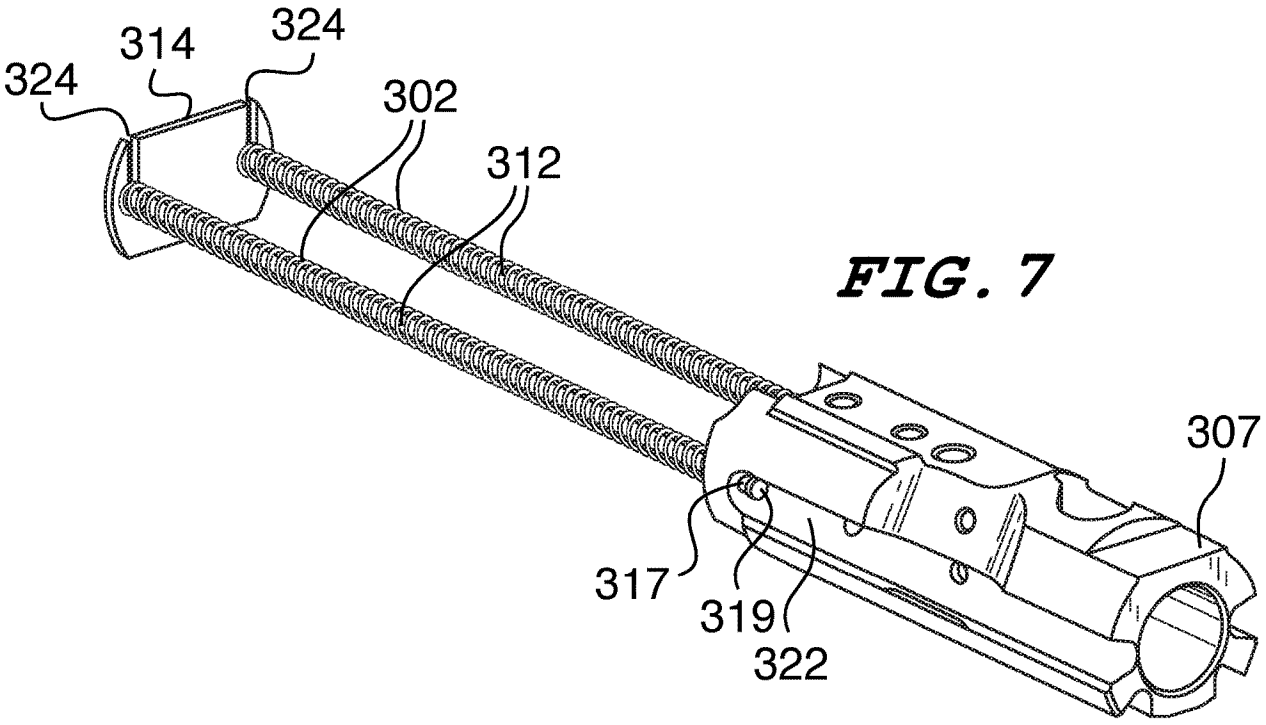
FIG. 7 is a top and side perspective view of a bolt carrier, guide rods, recoil springs, and the rear plate comprising the present shortened recoil system, according to an embodiment.
Figure 8:
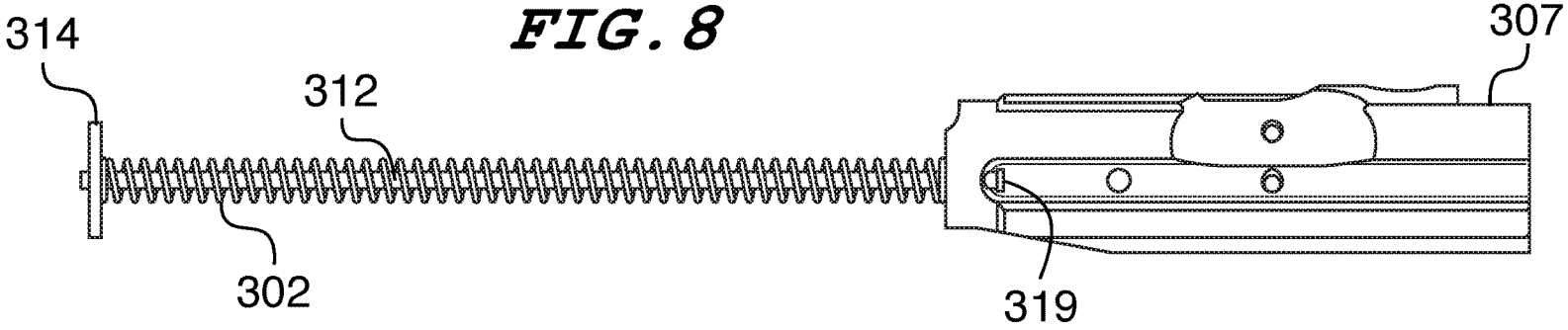
FIG. 8 is a side perspective view of a bolt carrier, guide rods, recoil springs, and the rear plate comprising the present shortened recoil system, according to an embodiment.

FIG. 7 is a top and side perspective view of a shortened bolt carrier 307, guide rods 312, recoil springs 302, and the rear plate 314 comprising the present shortened recoil system 301 (As shown in FIGS. 3-6), according to an embodiment. The recoil spring system 301 is similar to, but not identical to the AR-18 rifle's 100 recoil system 101 in that it comprises two smaller recoil springs 302 rather than one large recoil spring 202 such as those typically found in the AR-15 rifle 200. In an embodiment, the recoil springs 302 can be flat springs, but round springs, or other types of springs, which can provide force within the necessary range to actuate the recoil spring system 301 in the space allowed, can also be used. A guide rod 312 can be threaded through each recoil spring 302 and connect the shortened bolt carrier 307 to the rear plate 314 thus holding each recoil spring in position. According to an embodiment, the shortened bolt carrier 307 can comprise two guide rod channels 322, extending laterally along the side length of the shortened bolt carrier 307. Near the back of the shortened bolt carrier 307, each of the guide rod channels 322 can close and, a guide rod hole 317 can be located at this point as shown in FIGS. 7-9. The guide rods 312 can comprise a first end 319 which can be flared, capped, pinned, or otherwise modified so as not to be able to pass through the guide rod hole 317. According to an embodiment, the second end 318 of each of the guide rods 312 can comprise a slot (not shown in FIG. 7) configured to be received by corresponding rear plate slots 324 extending vertically through the rear plate 314.

FIG. 8 is a side perspective view of a shortened bolt carrier 307, guide rod 312, recoil spring 302, and the rear plate 314 comprising the present shortened recoil system 301, according to an embodiment. This view clearly shows how the present shortened bolt carrier 307 is designed to ride back and forth on the guide rods 312. Specifically, captured gas from a fired cartridge (not shown) can push the shortened bolt carrier 307 backward and the recoil springs 302 can push the shortened bolt carrier 307 forward returning it to its original position. The rear plate 314, the guide rod holes 317 and the receiver itself, in which the present recoil system will be contained (see FIG. 4), hold the shortened bolt carrier 307 in its proper position as it cycles back and forth each time a cartridge is fired. In the depicted embodiment, the guide rod 312 is shown as having a first end 319 which is capped, in order to retain the shortened bolt carrier 307 on the guide rod 312.

Figures 9A, 9B:
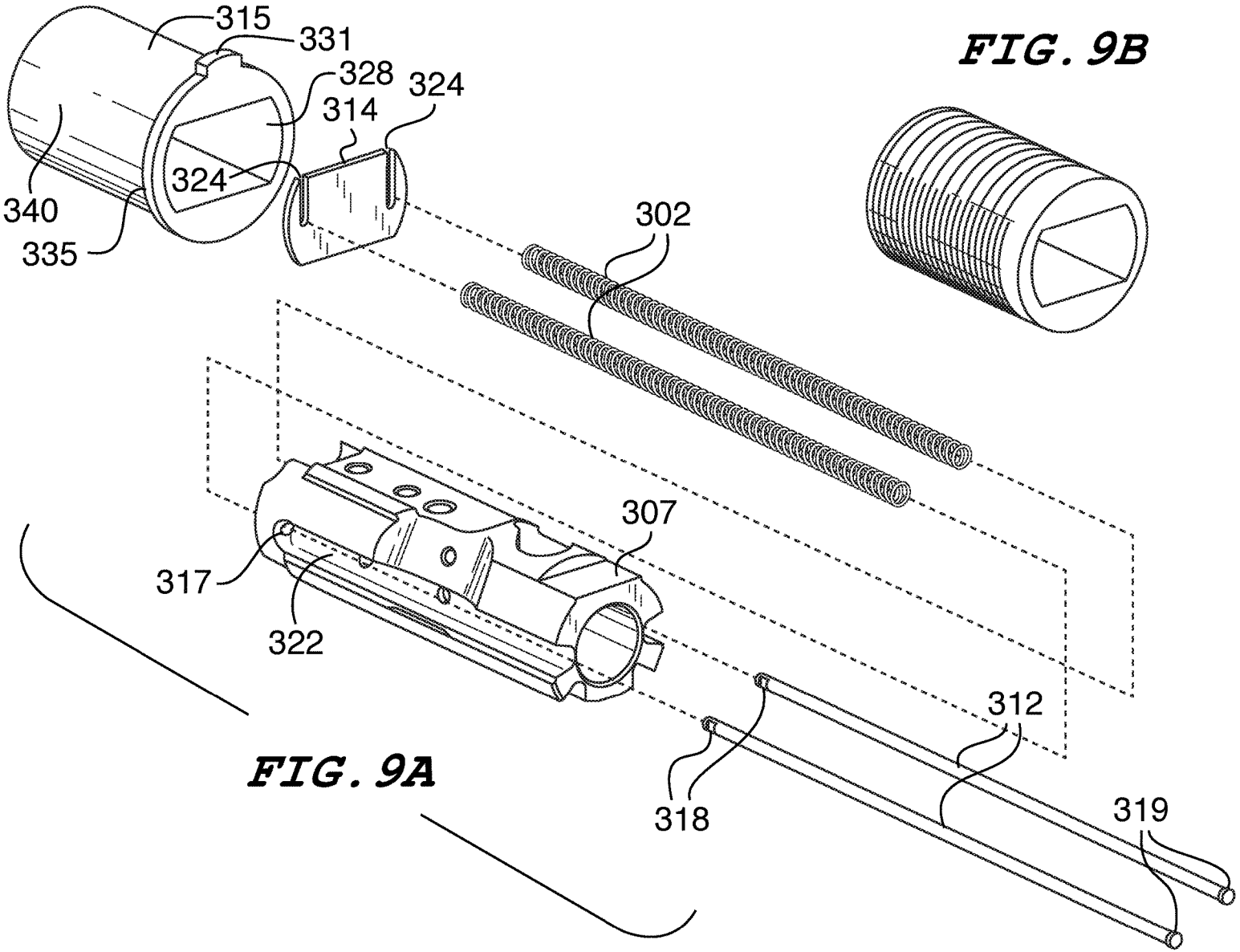
FIG. 9A is a top and side, perspective view of an exploded version of the present bolt carrier, guide rods, recoil springs, rear plate, and rear cup comprising the present shortened recoil system, according to an embodiment
FIG. 9B is a top and side, perspective view of and alternative rear cup design, according to an embodiment.

FIG. 9A is a top and side, perspective view of an exploded version of the present shortened bolt carrier 307, guide rods 312, recoil springs 302, rear plate 314, and rear cup 315 comprising the present shortened recoil system 301, according to an embodiment. This view shows how the guide rods 312 are threaded through the guide rod channels 322 and through the guide rod holes 317 to exit the rear of the shortened bolt carrier 307 so that the capped first ends 319 prevent the guide rods 302 from passing completely through the guide rod holes 317. Once the guide rods 312 pass through the rear of the shortened bolt carrier 307, the recoil springs 302 can be placed over the guide rods 312. According to an embodiment, the slotted second end 318 of the guide rods can then be placed in the corresponding slot 324 located in the rear plate 314.

Not shown in FIGS. 7 and 8, but shown in FIG. 9 is the rear cup 315 which is of sufficient size and shape to fit within the rear threaded section of the receiver (not shown). As discussed above, the traditional recoil system 201 extends through the receiver and far into the stock of the standard AR-15 rifle 200. In this embodiment, the rear cup 315 comprises one end of the present shortened recoil system 301. According to an embodiment, the rear cup 315 can comprise a recess 328 which can retain the rear plate 314 in a desired position within the receiver. While the recess shown in FIG. 9 is roughly the same shape as that of the rear plate 314, it can be any shape sufficient to contain the rear plate 314, if a rear plate 314 is used. The rear cup 315 can also comprise a flange 335 to prevent it from passing through the rear threaded section of the receiver. Additionally, in an embodiment, the flange 335 can comprise a tab 331 designed to prevent the rear cup 315 from rotating in the rear threaded section of the receiver. In an alternative embodiment, shown in FIG. 9B, the exterior surface 340 of the rear cup 315 can be partially or completely threaded to screw into the rear threaded section of the receiver 410.

Figure 10:
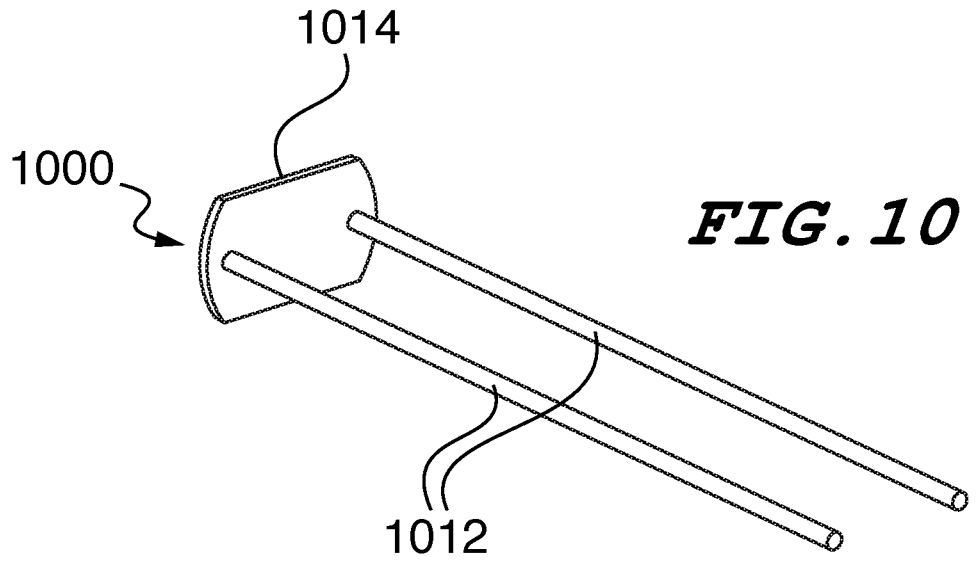
FIG. 10 is a top and side perspective view of an embodiment wherein the guide rods and rear plate are either molded as a single piece or are irremovably connected to each other, according to an embodiment.

FIG. 10 is a top and side perspective view of an embodiment wherein the guide rods 1012 and rear plate 1014 are either molded as a single piece 1000 or are irremovably connected to each other, which can be used in place of parts 312 and 314 in an alternative embodiment of the present shortened recoil system 301.

Figure 11:
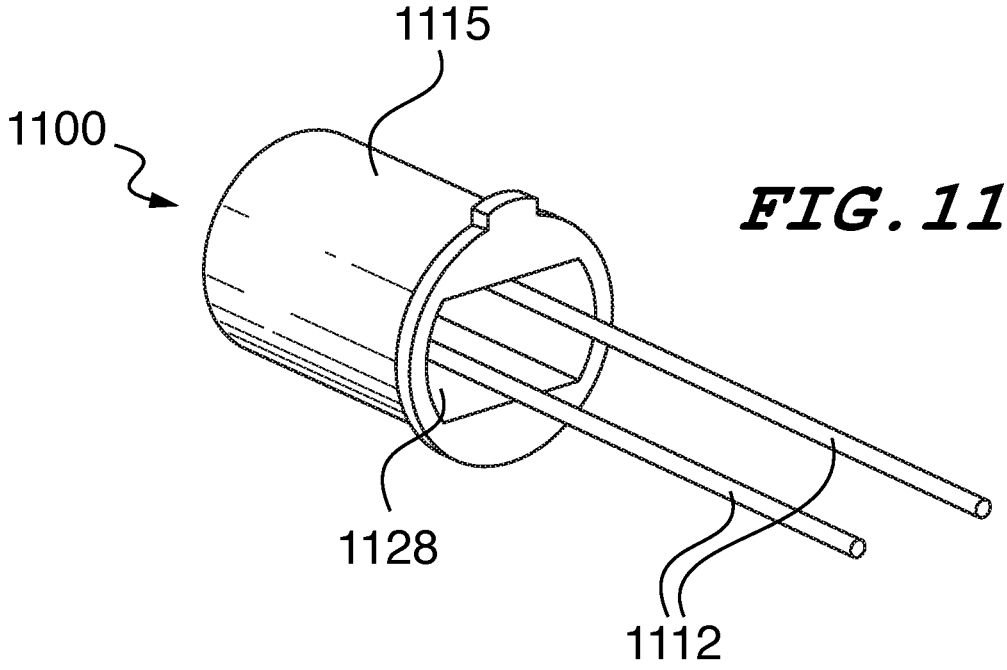
FIG. 11 is a top and side perspective view of guide rods and rear cup are either molded as a single piece or are irremovably connected to each other comprising an alternative embodiment of the present shortened recoil system, according to an embodiment.

FIG. 11 is a top and side perspective view of guide rods 1128 and rear cup 1115 are either molded as a single piece 1100 or are irremovably connected to each other, which can be used in place of parts 312, 314 and 315 in an alternative embodiment of the present shortened recoil system 301. In this embodiment, the rear plate 314 can be either eliminated entirely or incorporated into the rear cup 1115.

Figure 12:
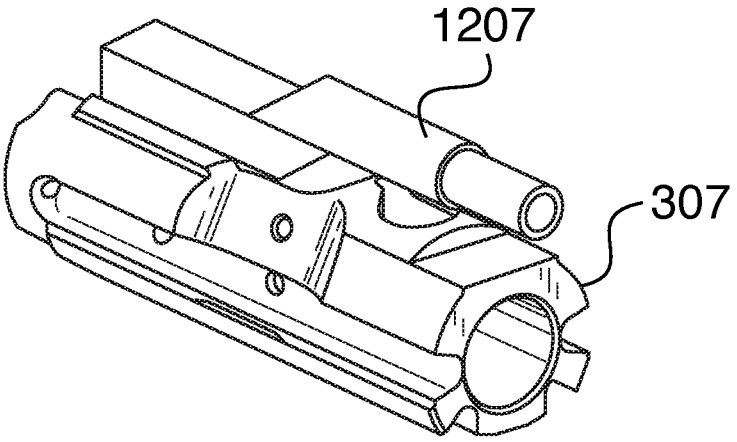
FIG. 12 is a top and side perspective view of a bolt carrier comprising an alternative embodiment of the present shortened recoil system, wherein the bolt carrier comprises a gas key which transfers gas to the bolt carrier and the present shortened recoil system allowing the gas to directly actuate the present shortened recoil system, according to an embodiment.

FIG. 12 is a top and side perspective view of the bolt carrier 307 comprising the present shortened recoil system 301, wherein the bolt carrier 307 comprises a gas key 1207 which transfers gas to the bolt carrier 307 and the present shortened recoil system 301 allowing the gas to directly actuate the present shortened recoil system 301, according to an embodiment. The gas key 1207 can be either removably connected to the bolt carrier 307, such as by screws or bolts, or can be molded as a single piece with the bolt carrier 307, or be irremovably connected to the bolt carrier 307.

Figure 13:
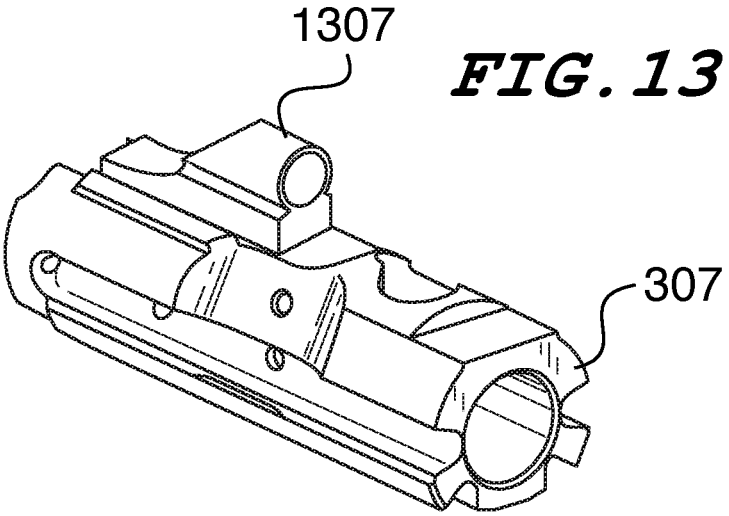
FIG. 13 is a top and side perspective view of the bolt carrier comprising the present shortened recoil system, wherein the bolt carrier comprises a strike face which can transfer the power of the gas to the bolt carrier through a gas piston, according to an embodiment.

FIG. 13 is a top and side perspective view of the bolt carrier 307 comprising the present shortened recoil system 301, wherein the bolt carrier 307 comprises a strike face 1307 which transfers the power of the gas to the bolt carrier 307 through a gas piston (not shown) and the present shortened recoil system 301 allowing the gas piston to actuate the present shortened recoil system 301, according to an embodiment. The strike face 1307 can also be either removably connected to the bolt carrier 307, such as by screws or bolts, or can be molded as a single piece with the bolt carrier 307, or be irremovably connected to the bolt carrier 307.

Although the present apparatus has been described in terms of exemplary embodiments, it is not limited thereto. Rather, the appended claims should be construed broadly, to include other variants and embodiments, which may be made by those skilled in the art without departing from the scope and range of equivalents of the disclosed apparatus.

What is claimed is:

1. A shortened recoil system comprising:

a bolt carrier, which is configured for use in a direct impingement system, wherein the bolt carrier comprises one or more guide rod channels located in the same horizontal plane as the bolt carrier;

one or more guide rods configured to fit within the guide rod channel;

one or more recoil springs through which a guide rod can be threaded; and a rear plate configured to hold one or more guide rods in a selected position.

2. The shortened recoil system as described in claim 1 wherein the one or more guide rod channels comprise a guide rod hole of sufficient size to allow a guide rod to pass through the guide rod hole.

3. The shortened recoil system as described in claim 1 wherein the one or more guide rods comprise a first end which is capped.

4. The shortened recoil system as described in claim 1 wherein the one or more guide rods comprise a second end comprising a slot.

5. The shortened recoil system as described in claim 1 wherein the rear plate comprises rear plate slots.

6. The shortened recoil system as described in claim 1 wherein the bolt carrier comprises a gas key.

7. The shortened recoil system as described in claim 1 wherein the bolt carrier comprises a strike face.

8. The shortened recoil system as described in claim 1 wherein the rear plate and the one or more guide rods are irremovably connected.

9. A method for using a shortened recoil system comprising:

providing a bolt carrier, which is configured for use in a direct impingement system, wherein the bolt carrier comprises one or more guide rod channels located in the same horizontal plane as the bolt carrier; one or more guide rods configured to fit within the guide rod channel; one or more recoil springs through which a guide rod can be threaded; and a rear plate configured to hold one or more guide rods in a selected position;

providing a rifle comprising an AR-15 rifle comprising a standard bolt carrier system;

removing the standard bolt carrier system from the AR-15 rifle;

installing the shortened recoil system in the AR-15 rifle; and operating the AR-15 rifle.

* * * * *